US006565344B2

(12) United States Patent
Bentley et al.

(10) Patent No.: US 6,565,344 B2
(45) Date of Patent: May 20, 2003

(54) APPARATUS FOR PRODUCING MULTI-COMPONENT LIQUID FILAMENTS

(75) Inventors: Rachelle Bentley, Cumming, GA (US); Steve Clark, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/802,651

(22) Filed: Mar. 9, 2001

(65) Prior Publication Data

US 2002/0127293 A1 Sep. 12, 2002

(51) Int. Cl.[7] ..... D01D 5/088; D01D 5/32

(52) U.S. Cl. ..... 425/72.2; 425/131.5; 425/463; 425/192 S; 425/DIG. 217

(58) Field of Search ..... 425/131.5, 72.2, 425/DIG. 217, 7, 192 S, 463; 264/172.14, 172.15

(56) References Cited

U.S. PATENT DOCUMENTS

| | | | | |
|---|---|---|---|---|
| 2,374,540 A | | 4/1945 | Hall | 18/47.5 |
| 2,411,659 A | | 11/1946 | Manning | 154/9 |
| 2,411,660 A | | 11/1946 | Manning | 154/101 |
| 2,437,263 A | | 3/1948 | Manning | |
| 2,508,462 A | | 5/1950 | Marshall | 18/8 |
| 3,181,201 A | * | 5/1965 | Seiz | 425/463 |
| 3,601,846 A | | 8/1971 | Hudnall | 18/8 |
| 3,615,995 A | | 10/1971 | Buntin et al. | 156/161 |
| 3,755,527 A | | 8/1973 | Keller et al. | 264/210 |
| 3,825,379 A | | 7/1974 | Lohkamp et al. | 425/72 |
| 3,825,380 A | | 7/1974 | Harding et al. | 425/72 |
| 3,841,953 A | | 10/1974 | Lohkamp et al. | 161/150 |
| 3,849,241 A | | 11/1974 | Butin et al. | 161/169 |
| 3,895,151 A | | 7/1975 | Matthews et al. | 428/102 |
| 3,949,130 A | | 4/1976 | Sabee et al. | 428/192 |
| 3,981,650 A | | 9/1976 | Page | 425/72 |
| 4,145,518 A | | 3/1979 | Morie et al. | 528/272 |
| 4,164,600 A | | 8/1979 | Yung et al. | 428/198 |
| 4,181,640 A | | 1/1980 | Morie et al. | 260/30.4 |
| 4,188,960 A | | 2/1980 | Morie et al. | 131/267 |

(List continued on next page.)

FOREIGN PATENT DOCUMENTS

| | | |
|---|---|---|
| JP | 50-90774 | 12/1973 |
| JP | 55-142757 | 4/1979 |
| JP | 57-176217 | 1/1982 |

OTHER PUBLICATIONS

, *Handbook of Fibers Raw Materials*, 6 pgs.
C.Z. Carroll–Porczynski, *Inorganic Fibres*, London National Trade Press Limited 1958, 5 pgs.
Robert R. Buntin and Dwight T. Lohkamp, *Melt Blowing—A One–Step Web Process for New Nonwoven Products*, Article, vol. 56, No. 4, Apr. 1973 (4 pgs.).

*Primary Examiner*—Nam Nguyen
*Assistant Examiner*—Brian L Mutschler
(74) *Attorney, Agent, or Firm*—Wood, Herron & Evans, L.L.P.

(57) ABSTRACT

A melt spinning apparatus including a spinpack with a die tip block having a recess with a converging portion, such as an angled trough, which terminates in a row of filament discharge outlets. The recess selectively receives a configuration insert, such as a side-by-side insert or a sheath-core insert, that separates the converging portion of the recess into two sheets of liquid that combine at the filament discharge outlets. The spinpack may be configured by inserting either of the inserts to produce filaments having different cross sectional configurations of two different materials. Separation of the two liquids prevents premature interaction between the two liquid flows which minimizes instabilities between the liquid flow interface. The minimization of these instabilities can result in less formation of shot and improve other significant finished product properties. In addition, each type of liquid material may be maintained at an optimum temperature for proper extrusion.

5 Claims, 11 Drawing Sheets

3A

U.S. PATENT DOCUMENTS

| | | | | | |
|---|---|---|---|---|---|
| 4,217,387 | A | | 8/1980 | Viezee et al. | 428/288 |
| 4,238,175 | A | | 12/1980 | Fujii et al. | 425/83.1 |
| 4,267,002 | A | | 5/1981 | Sloan et al. | 156/276 |
| 4,357,379 | A | | 11/1982 | Sloan et al. | 428/113 |
| 4,426,417 | A | | 1/1984 | Meitner et al. | 428/195 |
| 4,469,650 | A | | 9/1984 | Furukawa et al. | 156/62.4 |
| 4,547,420 | A | | 10/1985 | Krueger et al. | 428/229 |
| 4,560,385 | A | | 12/1985 | Baravian | 8/115.7 |
| 4,729,371 | A | | 3/1988 | Krueger et al. | 128/206.19 |
| 4,795,668 | A | | 1/1989 | Krueger et al. | 428/174 |
| 4,880,370 | A | * | 11/1989 | Krumm | 425/133.5 |
| 5,098,636 | A | * | 3/1992 | Balk | 264/171.1 |
| 5,511,960 | A | * | 4/1996 | Terakawa et al. | 264/12 |
| 5,580,581 | A | * | 12/1996 | Buehning | 264/12 |
| 5,601,851 | A | * | 2/1997 | Terakawa | 425/133.1 |
| 6,057,256 | A | | 5/2000 | Krueger et al. | 442/400 |
| 6,103,181 | A | | 8/2000 | Berger | 264/555 |
| 6,182,732 | B1 | | 2/2001 | Allen | 156/441 |

* cited by examiner

APPARATUS FOR PRODUCING MULTI-COMPONENT LIQUID FILAMENTS

CROSS-REFERENCE TO RELATED APPLICATIONS

This application is related to the following co-pending and commonly-owned application which was filed on even date herewith, namely U.S. Ser. No. 09/802,646 pending, entitled "APPARATUS AND METHOD FOR EXTRUDING SINGLE-COMPONENT LIQUID STRANDS INTO MULTI-COMPONENT FILAMENTS" and the disclosure of which is hereby incorporated by reference herein in its entirety.

FIELD OF THE INVENTION

The present invention generally relates to extruding filaments and, more particularly, to a melt spinning apparatus for producing spunbond or meltblown multi-component filaments.

BACKGROUND OF THE INVENTION

Melt spun fabrics manufactured from synthetic thermoplastics have long been used in a variety of applications including filtration, batting, fabrics for oil cleanup, absorbents such as those used in diapers and feminine hygiene products, thermal insulation, and apparel and drapery for medical uses.

Melt spun materials fall in the general class of textiles referred to as nonwovens since they comprise randomly oriented filaments, or fibers, made by entangling the fibers through mechanical means. The fiber entanglement, with or without some interfiber fusion, imparts integrity and strength to the fabric. The nonwoven fabric may be converted to a variety of end use products as mentioned above.

Although melt spun nonwovens may be made by a number of processes, the most popular processes are meltblown and spunbond processes, both of which involve melt spinning of thermoplastic material. Meltblown is a process for the manufacture of a nonwoven fabric wherein a molten thermoplastic is extruded from a die tip to form a row of filaments. The fibers exiting the die tip are contacted with converging sheets or jets of hot air to stretch or draw the filaments down to microsize diameter. The fibers are then deposited onto a collector in a random manner and form a nonwoven fabric.

The spunbond process involves the extrusion of continuous filaments through a spinneret with multiple rows of filaments. The extruded filaments are maintained apart and the desired orientation of the filaments is achieved, for example, by electrical charges, by controlled air streams, or by the speed of the collector. The filaments are collected on the collector and bonded by passing the layer of filaments through compacting rolls and/or hot roll calendaring.

Nonwoven materials are used in such products as diapers, surgical gowns, carpet backings, filters and many other consumer and industrial products. The most popular machines for manufacturing nonwoven materials use meltblown and spunbond apparatus. For certain applications, it is desirable to utilize multiple types of thermoplastic liquid materials to form individual cross-sectional portions of each filament. Often, these multi-component filaments comprise two components and, therefore, are more specifically referred to as bicomponent filaments. For example, when manufacturing nonwoven materials for use in the garment industry, it may be desirable to produce bicomponent filaments having a sheath-core construction. The sheath may be formed from a softer material that is comfortable to the skin of an individual and the core may be formed from a stronger, but perhaps less comfortable material having greater tensile strength to provide durability to the fabric. Another important consideration involves the cost of the material. For example, a core of inexpensive material may be combined with a sheath of more expensive material. The core may be formed from polypropylene or nylon and the sheath may be formed from a polyester or co-polyester. Many other multi-component fiber configurations exist, including side-by-side, tipped, and microdenier configurations, each having its own special applications. Various material properties can be controlled using one or more of the component liquids. These include, as examples, thermal, chemical, electrical, optical, fragrance, and anti-microbial properties. Likewise, many types of die tips exist for combining the multiple liquid components just prior to discharge to produce filaments of the desired cross-sectional configuration.

Various apparatus form bi-component filaments with a die tip comprising vertically or horizontally stacked plates. In particular, a meltblown die tip directs two flows of liquid material to opposing sides near the top of a stack of vertical plates. A spunbond die tip directs two different material flows to the top plate of a stack of horizontal plates. Liquid passages etched or drilled into the vertical or horizontal stack of plates direct the two different types of liquid material to a location at which they are combined and extruded at the discharge outlets as multi-component filaments. Various cross-sectional configurations of filaments are achieved, such as side-by-side and sheath-core configuration.

Using a stack of thin plates in either a vertical or horizontal orientation manner suffers from imperfect seals between plates. In a production environment, liquid pressure will cause adjacent plates to move slightly away from each other. Thus, small amounts of liquid of one type can leak through these imperfect seals, causing "shot" or small balls of polymer to be formed in the extruded filaments. The shot causes the multi-component filaments to form with problems such as reduced strength or increased roughness. Also, the stacked plates may not offer a substantial thermal barrier between the two types of liquid material. Consequently, the filaments of each liquid material may not combine at their respective optimum temperatures, possibly adversely affecting extrusion thereof.

Other apparatus avoid the use of stacked plates by having the two types of liquid material combine in a cavity prior to extrusion of the two types of liquid through multiple discharge passages. More specifically, two different types of liquid materials, such as thermoplastic polymers, initially reside side-by-side in the cavity and are delivered under pressure to the discharge passages where they are extruded in side-by-side relation as bicomponent filaments. Since the two liquid materials reside in side-by-side relation in the die cavity and discharge passages, this may lead to thermal problems or problems related to the materials improperly combining or mixing prior to extrusion.

For these reasons, it is desirable to provide apparatus and methods for melt spinning multi-component filaments without encountering various problems of prior melt spinning apparatus.

SUMMARY OF THE INVENTION

The present invention therefore provides an apparatus for melt spinning multiple types of liquid materials into multi-component filaments. In particular, a melt spinning apparatus of this invention includes a spinpack which forms either a side-by-side or sheath-core multi-component filament by combining strands formed from two different types of liquid at a plurality of discharge outlets.

In accordance with the invention, an apparatus for extruding at least first and second types of liquid into side-by-side filaments comprises a die tip block including a recess communicating with first and second sets of liquid discharge outlets communicating with each other. An insert is received in the recess and separates the recess into first and second liquid passages. The first liquid passages communicates with the set of first liquid discharge outlets and the second liquid passage communicates with the set of second liquid discharge outlets. The insert includes a first liquid input configured to receive the first type of liquid and to communicate with the first liquid passage and includes a second liquid input configured to receive the second type of liquid and to communicate with the second liquid passage. The first and second liquid passages respectively deliver the first and second types of liquid to the first and second sets of liquid discharge outlets to form the multi-component, side-by-side filaments.

The apparatus of this invention can also be configured for extruding first and second types of liquid material into sheath-core filaments. The apparatus includes a die tip block with a recess communicating with a plurality of multi-component filament discharge outlets. A sheath-core insert is received in the recess for separating the recess into first and second liquid passages. The sheath-core insert also has a central liquid passage. The first and second liquid passages are adapted to receive the first type of liquid and the central liquid passage is adapted to receive the second type of liquid. The first and second liquid passages converge toward the central liquid passage and intersect with the central liquid passage at the multi-component filament discharge outlets to form the multi-component filaments.

Preferably, the strands extruded at each liquid discharge outlet combine together immediately after extrusion to form the multi-component filaments. In another aspect of the invention, the sheath-core insert may be replaced with another insert for producing side-by-side filaments. This can allow the same die tip block to be used to produce either sheath-core or side-by-side filaments.

Various advantages, objectives, and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
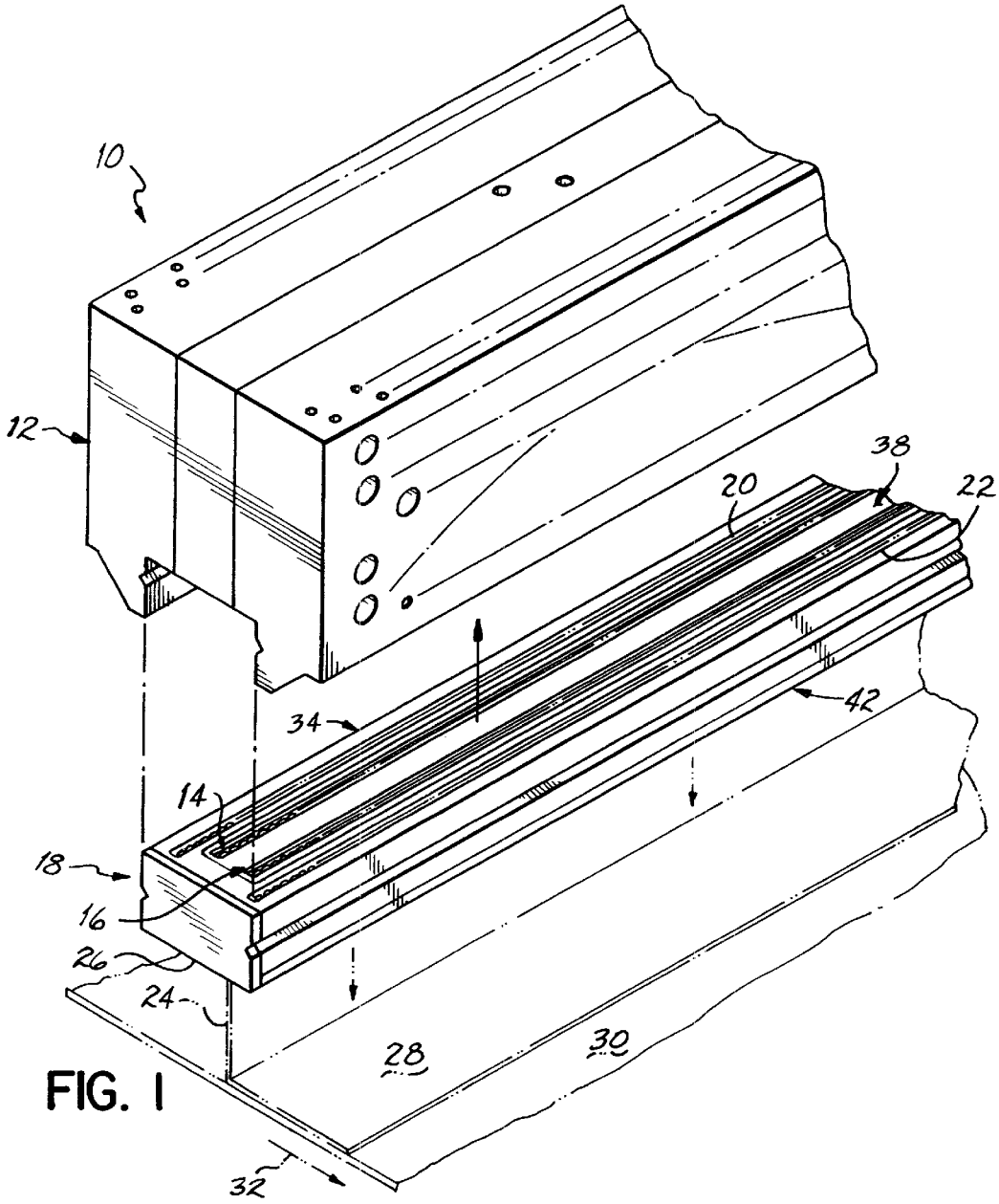
FIG. 1 is an exploded perspective view of a multi-component melt spinning apparatus constructed in accordance with the invention.

For purposes of this description, words such as "vertical", "horizontal", "vertex", "right", "left" and the like are applied in conjunction with the drawings for purposes of clarity. As is well known, melt spinning devices may be oriented in substantially any orientation, so these directional words should not be used to imply any particular absolute directions for a melt spinning apparatus consistent with the invention. In addition, the terms "different", "two types", and similar terminology with regard to the liquids employable with this invention are not meant to be restrictive, except to the extent that the two liquids have one or more different properties. The liquids may be the same polymer, for example, but have different physical properties due to different treatments.

With reference to FIGS. 1–4, a melt spinning assembly 10 constructed in accordance with the inventive principles includes a manifold assembly 12 for supplying two types of liquid material (e.g., polymer A and polymer B) respectively to liquid inputs 14, 16 of a spinpack 18. The particular liquid materials used will depend on the application and suitable types are well known in the art. The inputs 14 and 16 are sealed to the manifold assembly 12 such as by static seals retained within recesses (not shown) around each input 14, 16.

Figure 3A:
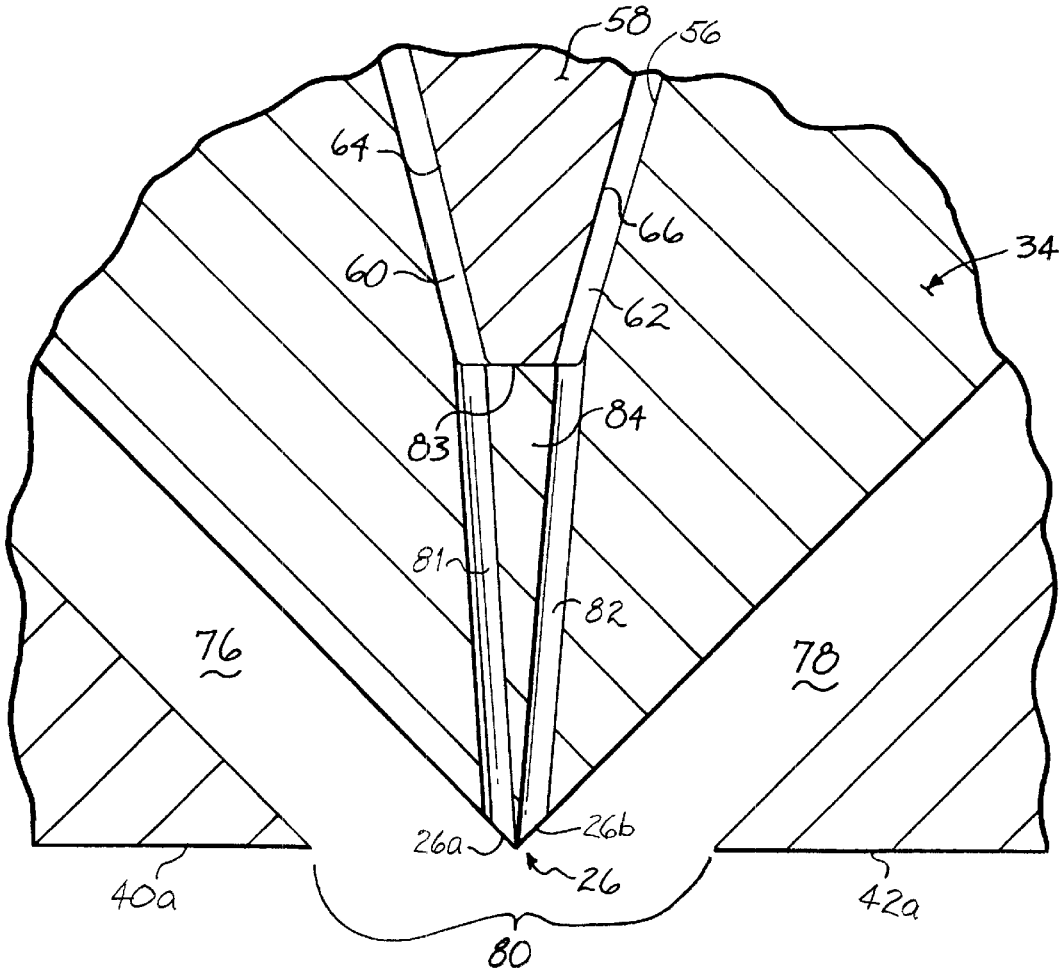
FIG. 3A is an enlarged cross-sectional view of a discharge outlet portion of the spinpack of FIG. 3.
Figure 4:
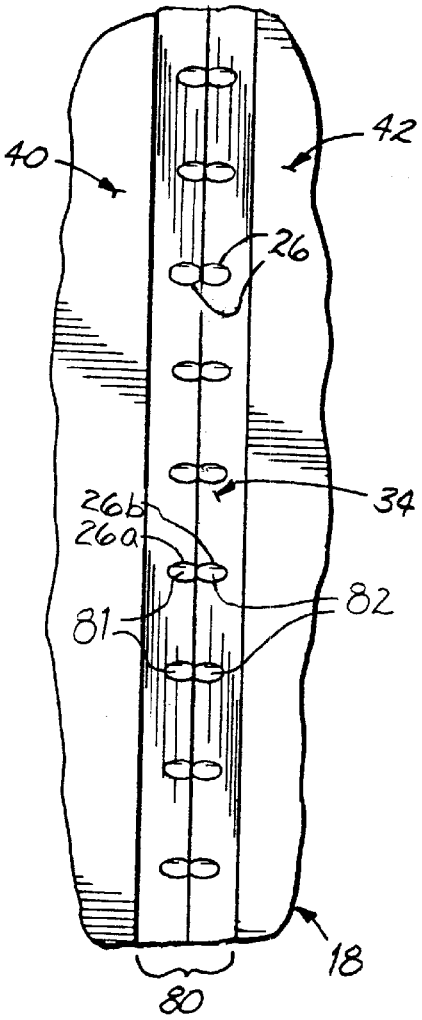
FIG. 4 is a partial bottom view of the assembled spinpack of FIG. 3.

Although melt spinning assembly 10 is specifically shown as an assembly for producing meltblown filaments, it will be readily understood that the same principles may be applied to a spinpack for spunbond applications. Manifold assembly 12 further supplies pressurized air (process air) to air passage inputs 20, 22 of the spinpack 18 when used for meltblown purposes. The process air attenuates multi-component filaments 24 extruded along the longitudinal length of the spinpack 18 from a row of multi-component filament discharge outlets 26. Extrusion of the two types of material actually occurs through separate outlets or orifices 26*a*, 26*b*, as shown in FIGS. 3A and 4. These orifices 26*a*, 26*b* merge or intersect into the oblong outlet 26. Outlets having other shapes may be used as well. The attenuated multi-component filaments 24 form a nonwoven fabric 28 upon a substrate 30 that generally is moving transverse to the melt spinning assembly 10, such as shown by arrow 32.

Figure 2:
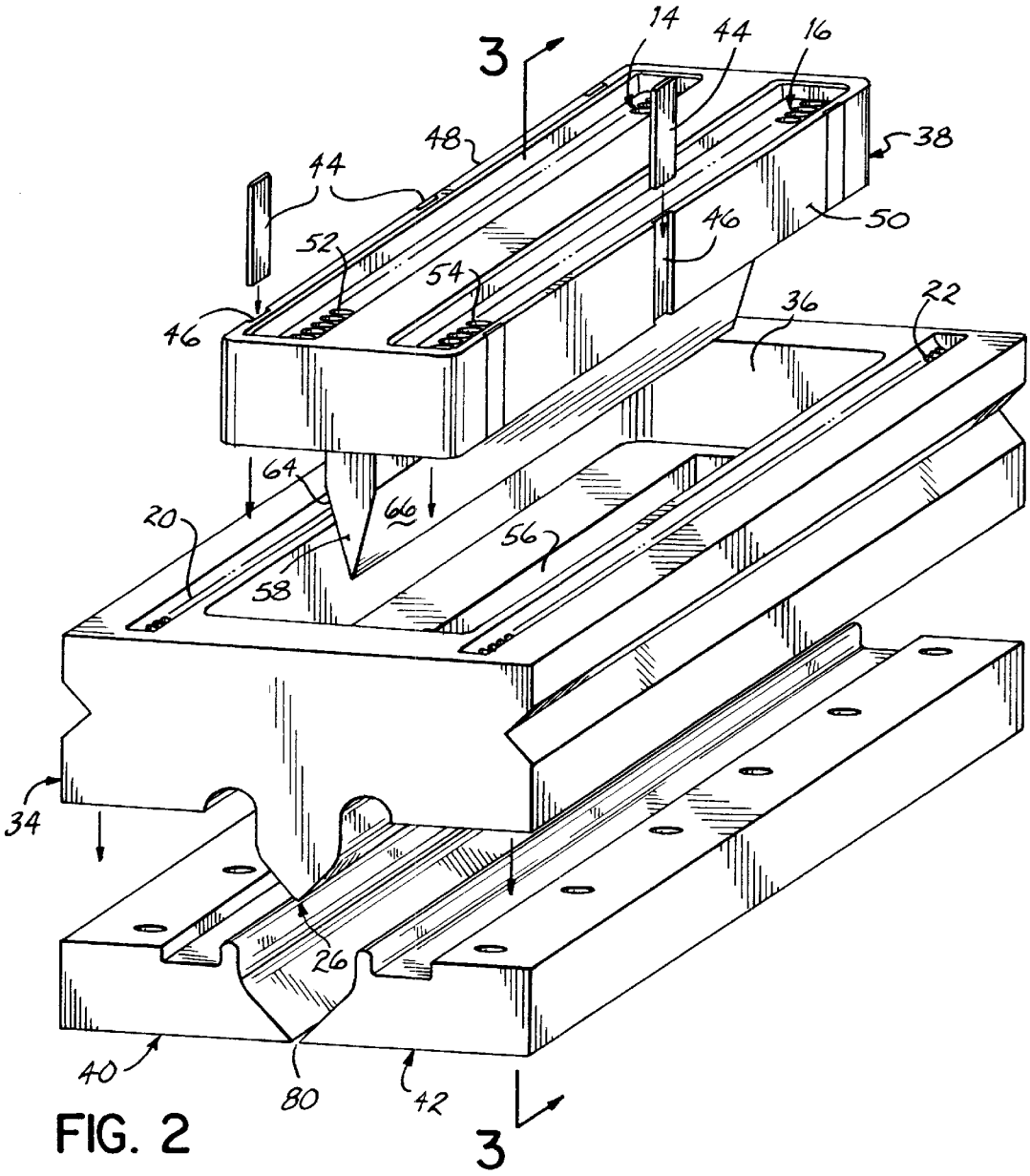
FIG. 2 is an exploded perspective view of a spinpack of the melt spinning apparatus of FIG. 1 constructed in accordance with the invention for producing a side-by-side filament.

With reference to FIG. 2, the spinpack 18 includes the filament producing features of the melt spinning assembly 10. A die tip block 34 includes a recess 36 for receiving an insert, which in this instance is an insert 38 for producing multi-component filaments having a side-by-side cross-section of two types of liquid. Thus, insert 38 is referred to herein as a side-by-side insert. Insert 38 may sometimes be referred to as a configuration insert since, in one aspect, it can allow an apparatus of the invention to be reconfigured in terms of he type of multi-component filament produced. The spinpack 18 further includes a pair of air knife plates 40, 42 attached below the die tip block 34 to focus process air upon multi-component filaments 24 extruded from the die tip block 34. Although air knife plates 40, 42 are shown with their lower surfaces 40*a*, 42*a* even or level with the apex of die tip block 34, these surfaces 40*a*, 42*a* may alternatively be above or below the apex depending on the application.

The side-by-side insert 38 may be adjusted laterally relative to its longitudinal axis within the recess 36, the advantages of which are discussed below with regard to FIG. 3. Spacers 44 of a predetermined thickness are inserted in a corresponding spacer slot 46 along one or both long sides 48, 50 of the side-by-side insert 38.

Figure 3:
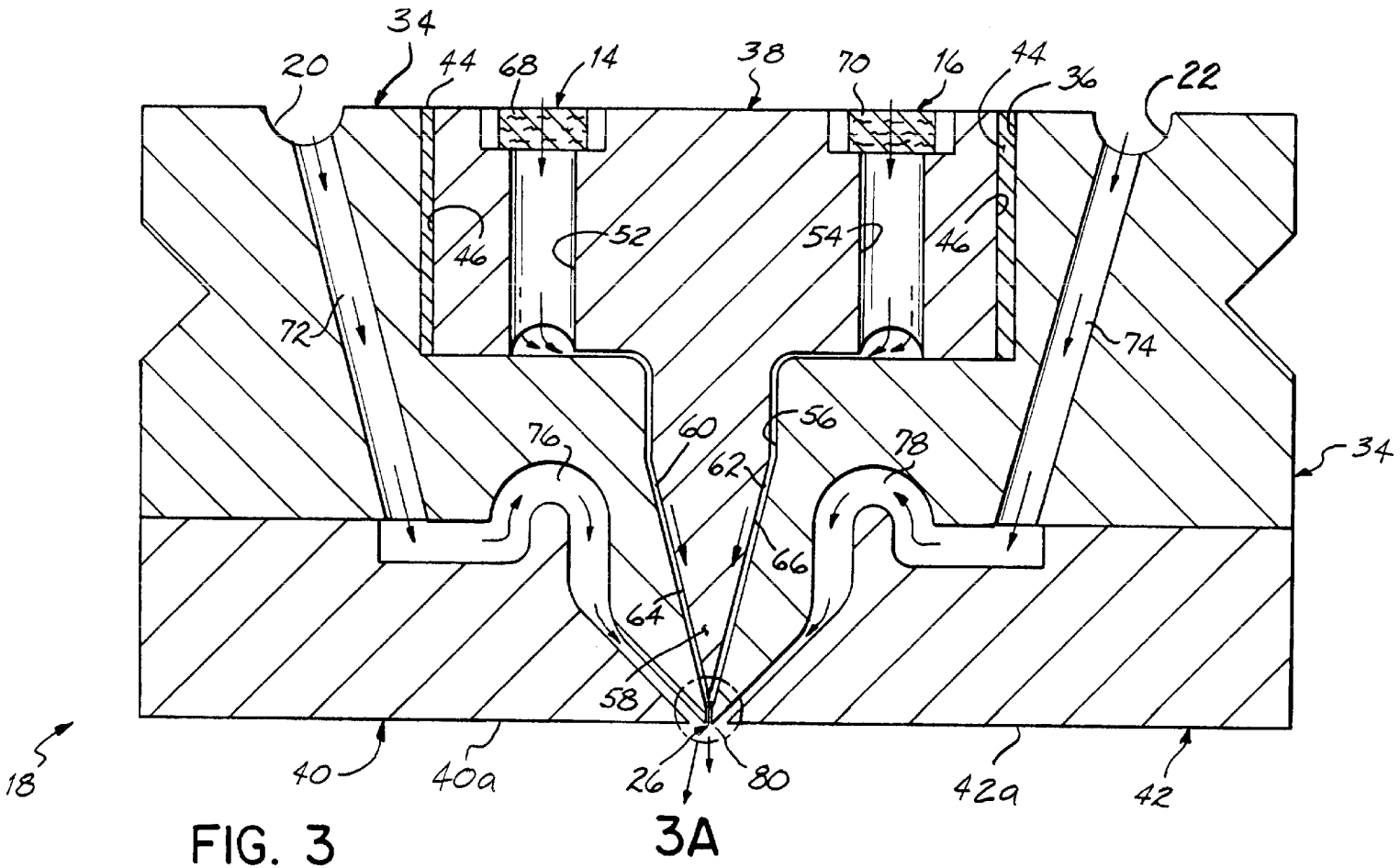
FIG. 3 is a cross section taken generally along line 3—3 of FIG. 2, but illustrating the spinpack in assembled condition.

With reference to FIG. 3, the spinpack 18 is depicted in assembled condition showing how the process air and the two types of liquid material are brought together at each multi-component filament discharge outlet 26*a*, 26*b*. The two types of liquid material (polymers A and B) are kept separate from one another until being brought into contact immediately after extrusion. With this unique configuration, premature leakage of one liquid material into the other is avoided. In addition, each liquid material is advantageously maintained at an optimum temperature for proper extrusion.

In particular, the recess 36 includes a converging portion, illustrated as an angled trough 56. The side-by-side insert 38 has a corresponding converging block portion 58 with longitudinal sides 64, 66 spaced away from the angled trough 56 to form first and second slots 60, 62. The first and second slots 60, 62 communicate with all of the multi-component filament discharge outlets 26 at a vertex of the angled trough 56.

Typically, each filament discharge outlet 26*a*, 26*b* is to receive the same flow rates of the two types of liquid material. Liquid filters 68, 70 at the liquid inputs 14, 16 protect the discharge outlets 26 from receiving contaminants to help ensure this uniform flow rate.

The relative lateral spacing of the converging block portion 58 with respect to the angled trough 56 advantageously shifts the relative cross-sectional area of slot portions 60, 62. Consequently, selection of spacers 44 of a desired thickness may be used to change the proportions of each liquid material, and may even be used to shut off one of the two types of liquid materials altogether. Further, the spacers 44 may accommodate differences in liquid material flow characteristics to achieve the desired proportions.

The die tip block 34 further includes air passages 72, 74 that respectively communicate between the air passage inputs 20, 22 and converging air channels 76, 78 formed between the air knife plates 40, 42 and the die tip block 34. The converging air channels 76, 78 communicate with each other to form an impinging air flow upon each extruded filament 24 at a slot 80, defined between the air knife plates 40, 42.

With reference to FIGS. 3A and 4, the discharge outlets 26*a*, 26*b* in the die tip block 34 are depicted as being configured to extrude two single component strands that combine after extrusion into a multi-component filament 24. In particular, the first slot portion 60 communicates with a row of first outlet passages 81 and the second slot portion 62 communicates with a row of second outlet passages 82. Slot portions 60, 62 advantageously have a lateral width sufficient for communication with the respective row of outlet passages 81, 82 when the insert 38 has been laterally adjusted for a desired proportional flow. A lower surface 83 of the side-by-side insert 38 is spaced away from the row of discharge outlets 26 by the length of the outlet passages 81, 82. Surface 83 seals against an upper surface of die tip block portion 84 defined between the rows of outlet passages 81, 82 and the angled trough 56.

The exact dimensions and relative placement of each outlet passage 81, 82 to form the respective discharge outlet 26 will depend upon the types of liquid materials extruded, temperatures employed, pressure of the process air, degree of filament attenuation desired, flow rate of liquid materials, the preferred configuration of the resulting nonwoven material, and other factors that will be apparent to those of ordinary skill. Furthermore, the width of converging air channels 76, 78 and slot 80 may vary, as well as the height between each discharge outlet 26 and slot 80 and the diameters of outlet passages 81, 82, according to the needs of the application.

With particular reference to FIG. 4, a bottom view of the spinpack 18 depicts the row of multi-component filament discharge outlets 26*a*, 26*b*, with each outlet formed by adjacent outlets of first and second outlet passages 81, 82. Thereby, each single component strand is kept separate from the other single component strand until immediately after extrusion.

Figure 7:
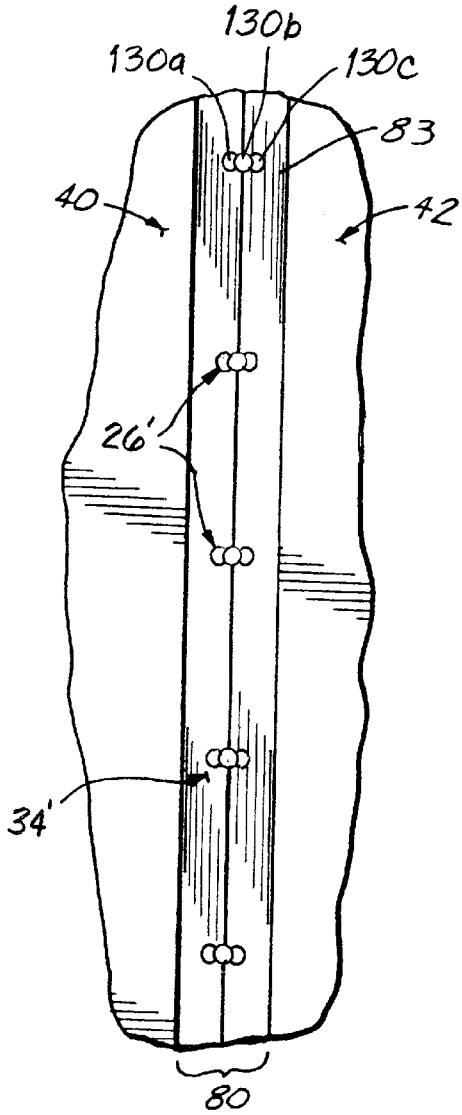
FIG. 7 is a partial bottom view of the assembled spinpack of FIG. 6.
Figure 5:
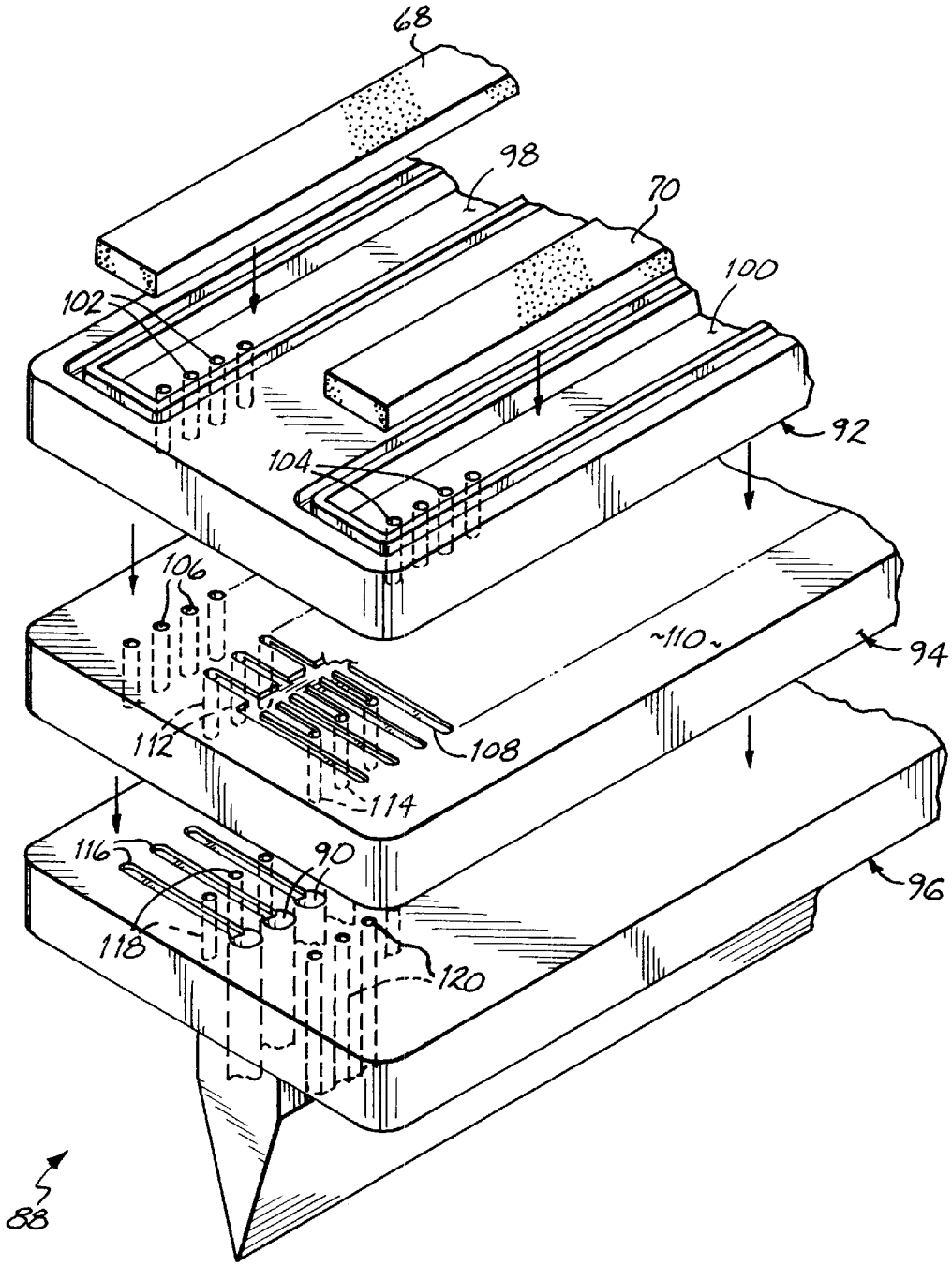
FIG. 5 is an exploded perspective view of one end of an insert constructed in accordance with the invention for producing a sheath-core filament.
Figure 6:
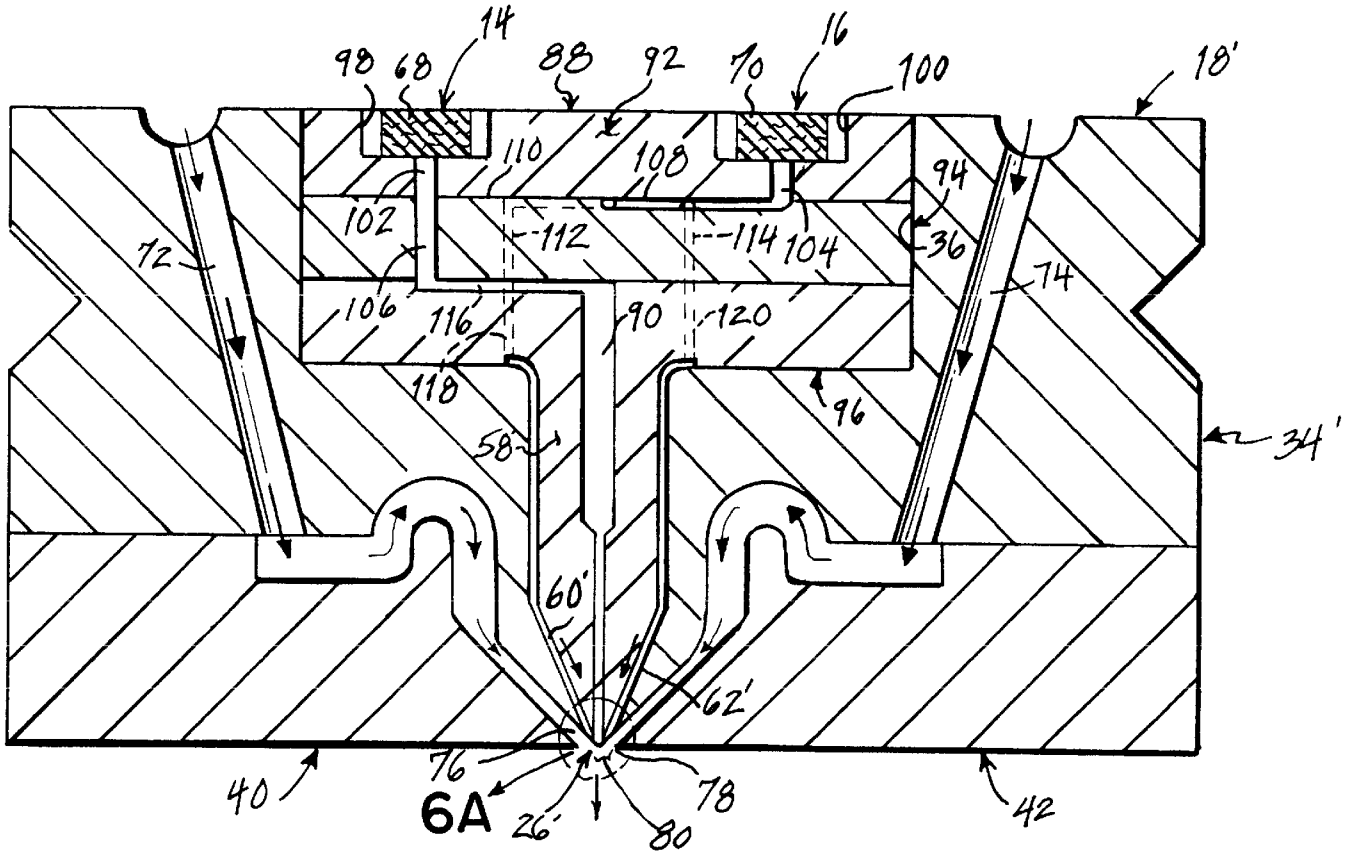
FIG. 6 is a cross section similar to FIG. 3, but based on FIG. 5.

With reference to FIGS. 5–7, elements with prime marks (') refer to corresponding, but slightly modified structure, relative to FIGS. 1–4. In this embodiment an insert 88, and a die tip block 34' are used to produce sheath-core filaments. Air knife plates 40, 42 may be reused when reconfiguring the spinpack 18' to produce sheath-core filaments 24.

The discussion above for FIGS. 1–4 for producing side-by-side filaments 24 is generally applicable to the sheath-core insert 88. The principle differences are that the sheath-core insert 88 conducts liquid material (polymer A) from the first liquid input 14 to central liquid passages 90 that communicate to the converged edge 83 of the sheath-core insert 88, each central liquid passage 90 aligned with a corresponding discharge outlet 26. Furthermore, the sheath-core insert 88 conducts liquid material (polymer B) from the second liquid input 16 to both slot portions 60', 62' between the side walls of converging block portion 58' and the angled trough 56' of the spinpack.

It is typically preferable to center the polymer A core within a cladding of the polymer B in the sheath-core filament 24. Consequently, the sheath-core insert 88 is not depicted as including spacers 44. The sheath-core insert 88 comprises a stacked filter plate 92, transfer plate 94, and converging block 96. The filter plate 92 holds each liquid filter 68, 70 in filter recesses 98, 100 respectively. A first row of vertical filter passages 102 communicates with the first filter recess 98 and a second row of vertical filter passages 104 communicates with the second filter recess 100.

The transfer plate 94 receives the two types of filtered liquid material from the filter plate 92. In particular, a first row of transfer passages 106 communicates respectively with the first row of filter passages 102. A transfer recess 108 on an upper surface 110 of the transfer plate 94 communicates with the second row of filter passages 104 from the filter plate 92 and with second and third rows of transfer passages 112, 114.

The converging block 96 includes a plurality of central recesses 116 that communicate respectively with each of the first row of transfer passages 106 and each of the central passages 90. The converging block 96 also includes a first row of side passages 118 that communicates respectively with the second row of transfer passages 112 and with the first slot portion 60'. The converging block 96 further includes a second row of side passages 120 that communicates with the third row of transfer passages 114 of the transfer plate 94 and with the second slot portion 62'.

Figure 6A:
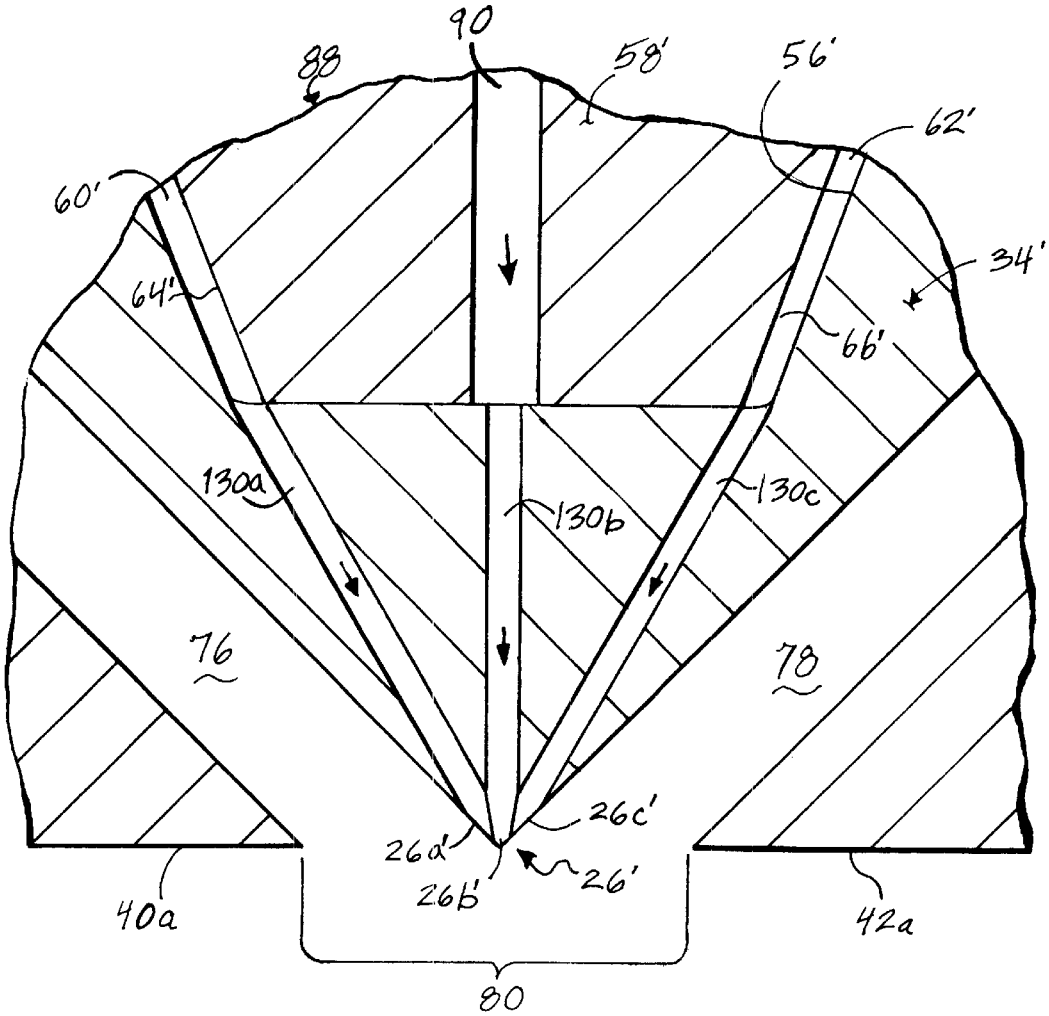
FIG. 6A is an enlarged cross-sectional view of a discharge outlet portion of the spinpack of FIG. 6.

Referring now to FIGS. 6A and 7, die tip block 34' includes three liquid passages 130*a*, 130*b*, 130*c* which intersect at a liquid discharge outlet 26' to essentially form a sheath-core filament. Liquid discharge passages 130*a*, 130*c* respectively communicate with slot portions 60', 62' and liquid discharge passage 130*b* communicates with central passage 90. A first type of liquid is introduced into slot portions 60', 62' and flows through passages 130*a*, 130*c* and a second type of liquid flows through central passage 90 and into liquid discharge passage 130*b*. The two types of liquid combine immediately after extrusion at outlet 26', formed by outlet portions 26*a*', 26*b*', 26*c*', to form a sheath-core filament. The filament may be impinged with process air directed through channels 76, 78. Alternatively, this type of sheath-core filament spinning apparatus may be used in a spunbond application without process air.

Figure 6B:
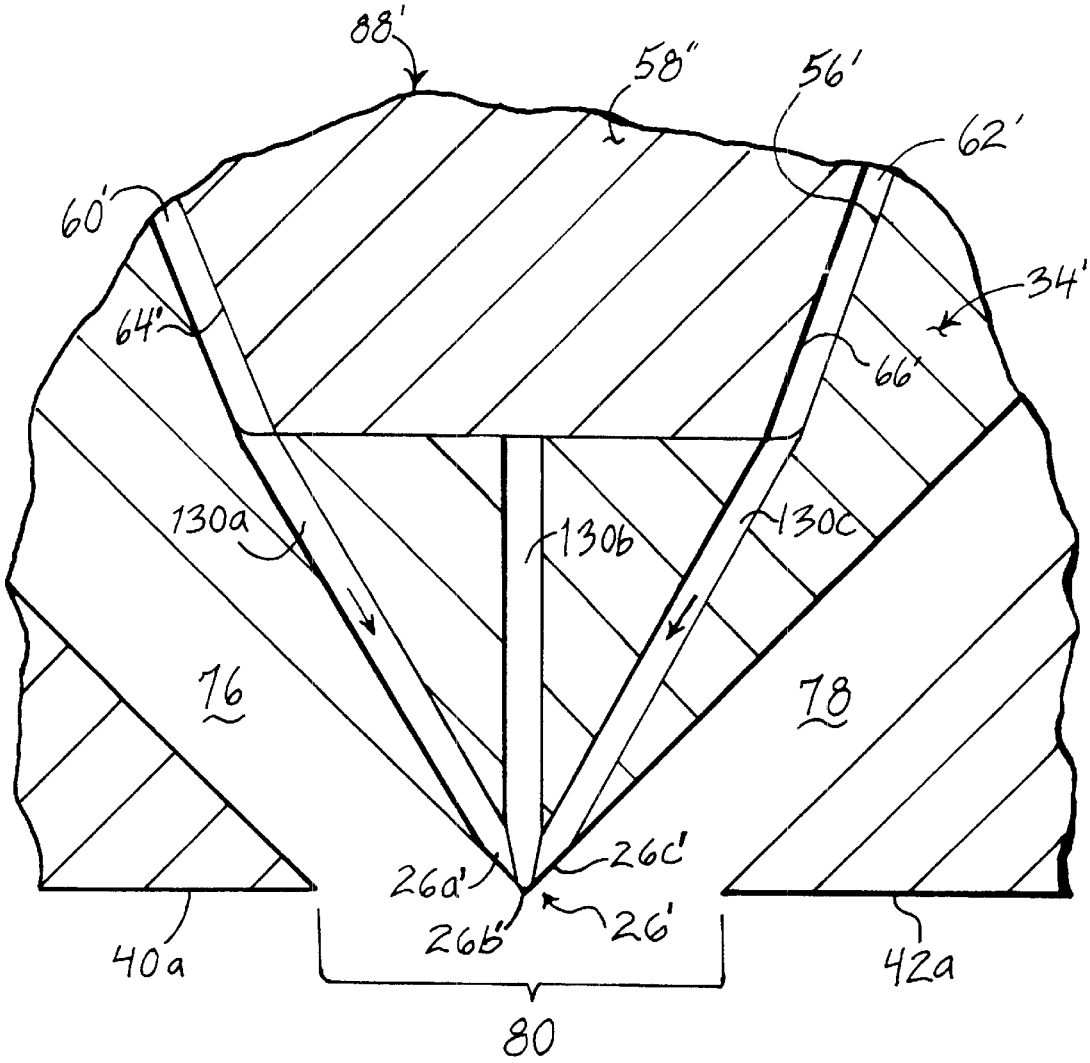
FIG. 6B is an enlarged cross-sectional view similar to FIG. 6A but illustrating an alternative insert.

Referring to FIG. 6B, an alternative insert 88' is shown having an alternative converging portion 58" which eliminates the central liquid passage 90. Insert 88' would also be configured as generally illustrated in FIG. 1 to receive first and second types of liquid material into the respective portions 60' and 62'. Thus, as in the first embodiment, the two types of liquid material will travel down passages 130*a*, 130*c* to discharge outlets 26*a*', 26*c*' and combine together just after extrusion into a multi-component side-by-side filament. Other structural elements shown in FIG. 6B have like reference numerals with respect to the previously described embodiments and the description thereof applies equally to this embodiment.

Figure 8:
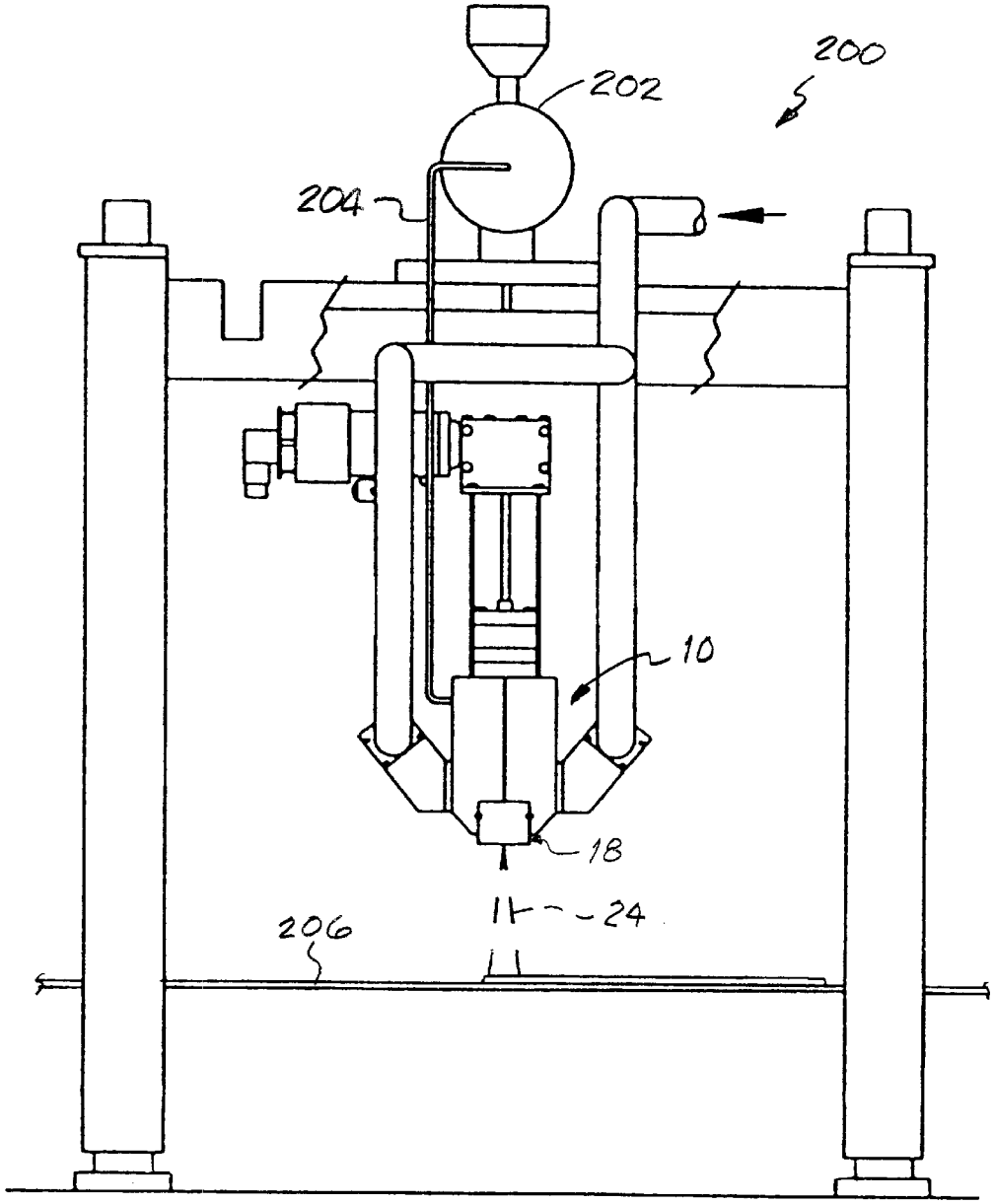
FIG. 8 is a diagrammatic view of a meltblown apparatus incorporating a meltspinning assembly of the present invention.

FIG. 8 illustrates a meltblown apparatus 200 using a melt spinning assembly 10 and a spinpack 18 constructed in accordance with this invention. The apparatus 200 may be any suitable meltblown apparatus, such as the apparatus disclosed in U.S. Pat. No. 6,182,732, assigned to the assignee of the present invention and the disclosure of which is hereby fully incorporated by reference herein. The apparatus 200 generally includes an extruder 202 with a polymer feedline 204 for feeding the first type of material to the melt spinning assembly 10. The second type of liquid material is also fed from a similar extruder and polymer feedline (not shown). The apparatus 200 is suitably supported above a substrate or carrier 206 for receiving the extruded multi-component filaments 24. The various other details of the apparatus 200 are not described herein as these details will be readily understood from a review of the patent disclosure incorporated above.

Figure 9:
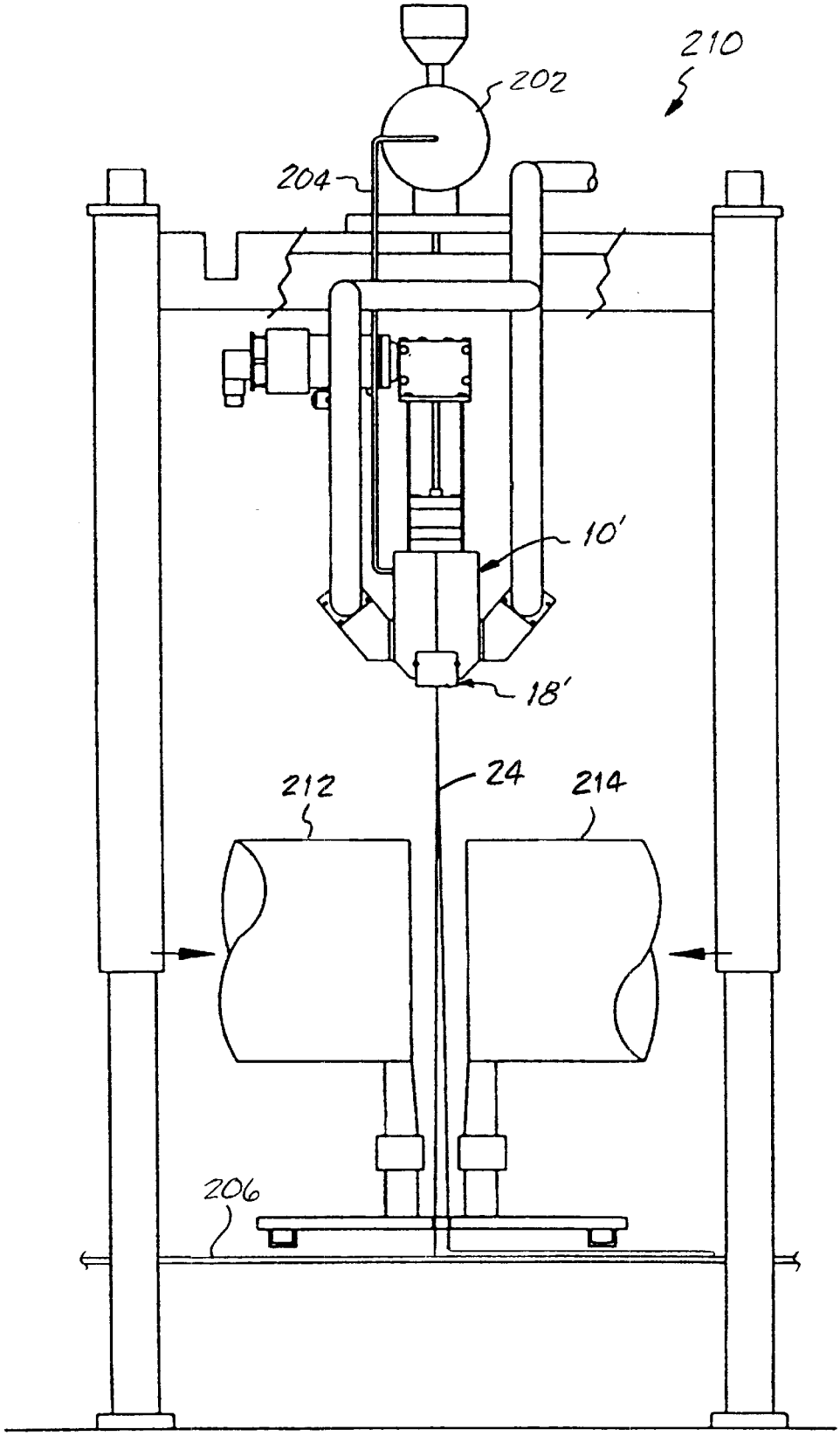
FIG. 9 is a diagrammatic view of a spunbond apparatus incorporating a meltspinning assembly of the present invention.

FIG. 9 illustrates a spunbond apparatus 210 using a melt spinning assembly 10' constructed in accordance with the invention, except that in the case of a spunbond application, the spinpack 18' need not include air knife components and air passages for delivering process air adjacent to the extruded multi-component filaments 24. The spunbond apparatus 210 shown in FIG. 9 may be constructed in a conventional manner, or as disclosed in U.S. Pat. No. 6,182,732. This apparatus further includes air quench ducts 212, 214 for purposes that will be readily understood by those of ordinary skill in the art. It will be understood that spinpack 18' may also be modified by those of ordinary skill to include multiple rows of multi-component filament discharge outlets.

While the present invention has been illustrated by a description of various preferred embodiments and while these embodiments has been described in some detail, it is not the intention of the applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein what is claimed is:

1. A melt spinning apparatus for extruding at least first and second liquids into multi-component filaments having a side-by-side cross-sectional configuration of the first and second liquids, comprising:

a die tip block including a recess communicating with a set of first liquid discharge outlets and a set of second liquid discharge outlets arranged in respective pairs of said first and second liquid discharge outlets communicating with each other;

an insert received in said recess and separating said recess into first and second liquid passages, said first liquid passage communicating with said set of first liquid discharge outlets and said second liquid passage communicating with said set of second liquid discharge outlets, said insert including a first liquid input configured to receive the first liquid and to communicate with said first liquid passage and including a second liquid input configured to receive the second liquid and to communicate with said second liquid passage, said first and second liquid passages respectively delivering the first and second liquids to said first and second sets of liquid discharge outlets to form the multi-component filaments; and a spacer received within said recess between said die tip block and said insert, said spacer having a predetermined thickness to selectively offset said insert with respect to said recess and change respective width dimensions of said first and second liquid passages.

2. The apparatus of claim 1, wherein said recess includes a converging portion and said first and second liquid passages are contained in said converging portion.

3. The apparatus of claim 2, wherein said converging portion of said recess comprises a trough formed from angled side walls and having a plurality of multi-component filament discharge outlets longitudinally aligned along a vertex of said trough.

4. The apparatus of claim 3, wherein said insert comprises:

a converging block having first and second sides parallel with and spaced away from said angled side walls of said trough to respectively form said first and second liquid passages as slots.

5. The apparatus of claim 1, wherein said die tip block further includes a plurality of first outlet passages and a plurality of second outlet passages, each multi-component filament discharge outlet formed by a pair of first and second outlet passages that communicate respectively with said first and second liquid passages.

* * * * *